US008490786B2

(12) United States Patent
Rohr et al.

(10) Patent No.: US 8,490,786 B2
(45) Date of Patent: Jul. 23, 2013

(54) INVERTED DOME TO SUPPLY DOSE

(75) Inventors: Robert Dale Rohr, La Otto, IN (US); Kenneth Edward Milligan, Harrisville, RI (US); Richard Arthur Laveault, Cheshire, MA (US); Derek David Hopkins, Deerfield, NH (US)

(73) Assignee: Liquid Health Labs, Inc., Deerfield, NH (US)

( * ) Notice: Subject to any disclaimer, the term of this patent is extended or adjusted under 35 U.S.C. 154(b) by 0 days.

(21) Appl. No.: 12/658,295

(22) Filed: Feb. 10, 2010

(65) Prior Publication Data

US 2011/0000800 A1 Jan. 6, 2011

Related U.S. Application Data

(60) Provisional application No. 61/207,470, filed on Feb. 11, 2009.

(51) Int. Cl.
*B65D 25/08* (2006.01)

(52) U.S. Cl.
USPC ..... 206/221; 206/222; 215/DIG. 8

(58) Field of Classification Search
USPC ..... 206/219, 221, 222; 215/DIG. 8, 215/47, 49, 50; 222/80, 83
See application file for complete search history.

(56) References Cited

U.S. PATENT DOCUMENTS

| | | | | | |
|---|---|---|---|---|---|
| 2,764,157 | A | * | 9/1956 | Oliva et al. | 206/221 |
| 2,764,983 | A | * | 10/1956 | Pius et al. | 206/220 |
| 2,813,649 | A | * | 11/1957 | Lipari | 215/11.1 |
| 3,347,410 | A | * | 10/1967 | Schwartzman | 222/80 |
| 3,441,179 | A | * | 4/1969 | Ragan | 222/129 |
| 3,539,794 | A | * | 11/1970 | Kennerly et al. | 362/34 |
| 4,463,862 | A | * | 8/1984 | Hansen | 215/50 |
| 4,671,420 | A | * | 6/1987 | Marcus | 215/44 |
| 4,886,175 | A | * | 12/1989 | Schlaudecker | 215/47 |
| 5,054,267 | A | * | 10/1991 | Dundas | 53/477 |
| 5,188,250 | A | * | 2/1993 | Kovacic et al. | 215/48 |
| 5,373,937 | A | * | 12/1994 | Lamboy | 206/221 |
| 5,542,528 | A | * | 8/1996 | Lanfranconi et al. | 206/221 |
| 5,839,573 | A | * | 11/1998 | Morini | 206/221 |
| 5,853,109 | A | * | 12/1998 | Elliott | 222/83 |
| 5,950,819 | A | * | 9/1999 | Sellars | 206/221 |
| 5,979,164 | A | * | 11/1999 | Scudder et al. | 62/4 |
| 6,257,428 | B1 | * | 7/2001 | Caola | 215/11.1 |

(Continued)

FOREIGN PATENT DOCUMENTS

| | | |
|---|---|---|
| EP | 0251259 A1 | 1/1988 |
| FR | 2565939 A1 | 12/1985 |

(Continued)

OTHER PUBLICATIONS

Claims of Co-pending U.S. Appl. No. 13/577,490.

*Primary Examiner* — David Fidei
(74) *Attorney, Agent, or Firm* — Nevrivy Patent Law Group P.L.L.C.

(57) ABSTRACT

The invention provides a dispensing closure to supply a dose with an inverted dome having a housing, the housing having a septum, a convex dome, and an end plate seal. A main vessel can be attached to the inverted dome dispensing closure, and a user-actuated means for dispensing from the inverted dome dispensing closure into the main vessel is also provided. The invention provides a point of use dispensing device that will supply fresh healthy ingredients that are stored inside the closure.

22 Claims, 3 Drawing Sheets

U.S. PATENT DOCUMENTS

| | | | | |
|---|---|---|---|---|
| 6,257,463 | B1 * | 7/2001 | De Polo | 222/525 |
| 6,302,268 | B1 * | 10/2001 | Michaeli | 206/221 |
| 6,325,226 | B1 | 12/2001 | Krautkramer | |
| 6,435,341 | B1 * | 8/2002 | Nobbio | 206/219 |
| 6,886,686 | B2 | 5/2005 | Anderson | |
| 7,055,684 | B2 | 6/2006 | Anderson | |
| 7,568,576 | B2 * | 8/2009 | Sweeney et al. | 206/219 |
| 7,703,642 | B2 * | 4/2010 | Scott | 222/522 |
| 7,874,420 | B2 | 1/2011 | Coon | |
| 2002/0066748 | A1 * | 6/2002 | Weiler et al. | 222/129 |
| 2003/0213709 | A1 | 11/2003 | Gibler | |
| 2004/0050881 | A1 | 3/2004 | Deussen | |
| 2005/0184090 | A1 | 8/2005 | DeJonge | |
| 2005/0263414 | A1 * | 12/2005 | Harilela et al. | 206/221 |
| 2006/0118435 | A1 * | 6/2006 | Cronin et al. | 206/219 |
| 2008/0290061 | A1 | 11/2008 | Seelhofer | |
| 2009/0057262 | A1 | 3/2009 | Cho | |
| 2009/0139882 | A1 | 6/2009 | DeJonge | |
| 2009/0260999 | A1 * | 10/2009 | Yang et al. | 206/219 |
| 2009/0308831 | A1 | 12/2009 | Anderson | |
| 2011/0174642 | A1 | 7/2011 | Coon | |
| 2012/0217178 | A1 | 8/2012 | Rohr | |

FOREIGN PATENT DOCUMENTS

| | | | |
|---|---|---|---|
| FR | 2885356 | A1 | 11/2006 |
| GB | 698914 | A | 10/1953 |
| GB | 1004473 | A | 9/1965 |
| KR | 10-2003-0027931 | | 4/2003 |
| KR | 10-2004-0103234 | A | 12/2004 |
| WO | 95/05321 | A1 | 2/1995 |
| WO | 2006/052827 | A2 | 5/2006 |
| WO | 2009/127039 | A1 | 10/2009 |
| WO | 2011/099995 | A1 | 8/2011 |

* cited by examiner 100
300

100
300
A
A 100
150
280
110
270

100
150
280
B
B
270

100
150
320
280
290
310
330
270
140
100
180

300
150
180
290
260
100
320
140

INVERTED DOME TO SUPPLY DOSE

CROSS REFERENCE TO RELATED APPLICATIONS

This application claims the benefit of provisional application Ser. No. 61/207,470, filed on Feb. 11, 2009.

BACKGROUND OF THE INVENTION

This invention relates generally to the field of packages and containers, and in particular, pertains to containers having two compartments and that may be used to keep two components separate until use.

It is desirable to fit a device to the top of a beverage that can dose or supply a product. It is also an advantage to the consumer to provide a dispensing method once the dose or supply has been delivered to the main receptacle vessel.

Twist to open technology provides limited opening port, increased operational forces and a steep learning curve for use by the end user. Ingredients housed are often compromised when the mating components are not properly aligned. This failure breaches the seal integrity for the ingredients and may not be readily known by the manufacturer or the end user. These devices may also contain multiple parts to achieve the actions needed to house product and twist to dispense. Other products require a great deal of force to open the closure and is commonly opened by slamming the head of the closure down onto a hard surface in order to breach the sealed portion of the closure thereby allowing access to ingredients.

BRIEF SUMMARY OF THE INVENTION

The primary object of the invention is to provide a point of use dispensing device that can dose or supply fresh healthy ingredients.

Another object of the invention is to provide a point of use dispensing device that protects against accidental dispension.

Another object of the invention is to provide a point of use dispensing device with a maximum dispensing port.

A further object of the invention is to provide a point of use dispensing device which is constructed from a minimal number of components and amount of materials.

Yet another object of the invention is to provide a point of use dispensing device that can be more easily assembled.

Still yet another object of the invention is to provide a point of use dispensing device that can be more easily filled.

Another object of the invention is to provide a point of use dispensing device that retains the integrity of ingredients.

Another object of the invention is to provide a point of use dispensing device that minimizes exposure of contained ingredients from UV light and moisture.

A further object of the invention is to provide a point of use dispensing device that is intuitive to use.

Yet another object of the invention is to provide a point of use dispensing device that is easy to operate.

Still yet another object of the invention is to provide a point of use dispensing device requiring no twisting motion for operation.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an inverted dome to supply dosing means comprising: an inverted dome dispensing closure having a housing, the housing having a septum, a thinner convex dome, and an end plate seal, a main vessel attached to said inverted dome dispensing closure, and a user-actuated means for dispensing from said inverted dome dispensing closure into said main vessel.

In accordance with a preferred embodiment of the invention, there is disclosed a process for Inverted dome to supply dosing means comprising the steps of: an inverted dome dispensing closure having a housing, the housing having a septum, a thinner convex dome, and an end plate seal, a main vessel attached to said inverted dome dispensing closure, and a user-actuated means for dispensing from said inverted dome dispensing closure into said main vessel.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The present invention provides a point of use dispensing device that will supply fresh healthy ingredients that are stored inside the closure. The device is used to store ingredients protecting them from UV light and moisture at a minimum. The closure will be intuitive for use and easily operated by the end user. The new device minimizes components and materials while maximizing the dispensing port.

A dispensing closure 100 is used to house or carry the dose or supply that when activated delivers the dose and allows the end user to dispense the product as desired without the removal of the dispensing closure from the bottle or container.

Figure 10:
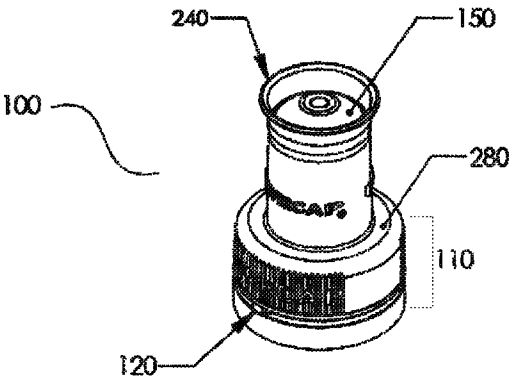
FIG. 10. Perspective view of TE dosing closure with a standing radial rim.
Figure 9:
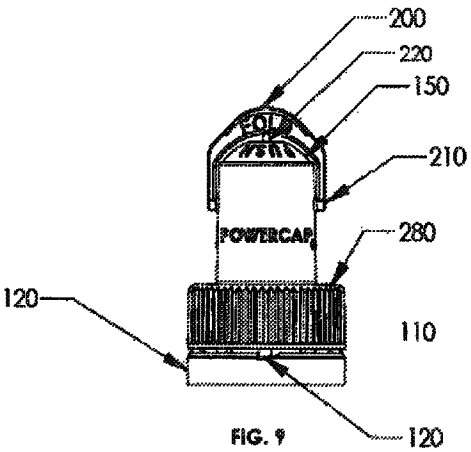
FIG. 9 Front view of the TE dosing closure with truss feature.
Figure 7:
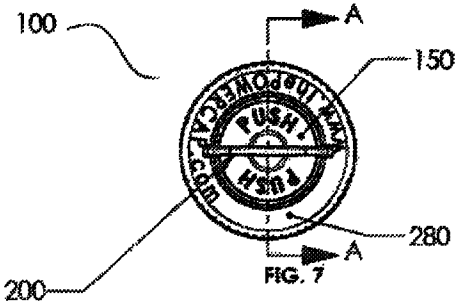
FIG. 7: Top view of the TE dosing closure with a truss feature.
Figure 8:
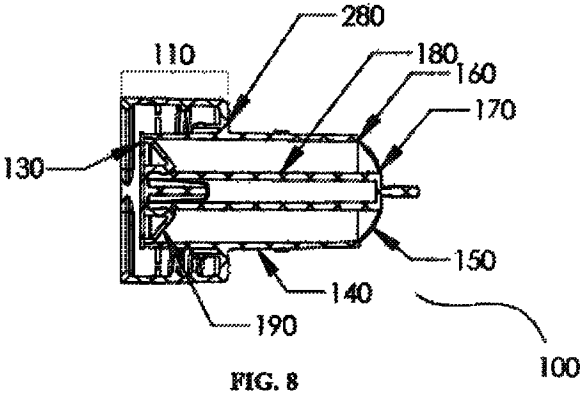
FIG. 8: Cross section assembly view of the TE dosing closure with truss feature.
Figure 11:
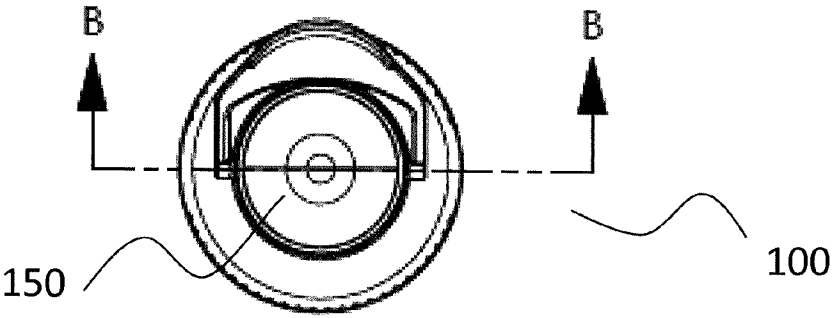
FIG. 11. Top view of the inverted dome concept with a fold away truss and the dome in the inverted position.
Figure 12:
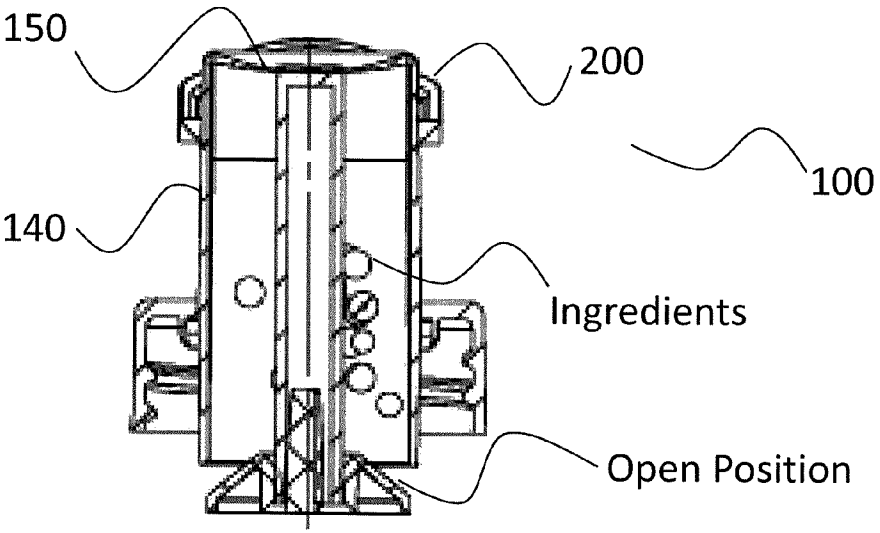
FIG. 12. Cross section view of the inverted dome concept with a fold away truss and the dome in the inverted position.

The closure radial skirt 110 to which threads are typically used but not limited to for attachment to a vessel opening. The vessel opening is sealed via a depending radial member 110 used to interferingly engage the opening portion of said vessel. The depending skirt 110 shown (in FIGS. 9-10) has a frangible TE skirt 120. The depending skirt 110 can be used with or without the depending TE skirt band 120. The closure may also employ the use of a foil liner 130 to add to product efficacy and tamper evidence. Depending from said skirt 110 is a tube 140 at the distal end of the tube is a dome portion 150. The dome portion can be but is not limited to a thin uniform wall section that can be readily deformed when sufficient force is applied to said dome. The dome is configured with two hinge elements 160, 170, one at the radial edge of the tube 160 and one at the radial edge of the septum 170. The said hinges are configured in a manner to allow the dome to flex to a maximum inverted position and at the apex of said dome a depending septum 180 extends toward the base of the closure. The distal end of the septum is configured to receive an end cap 190 in mating engagement. A foil liner 130 can be applied over said end cap 190 and distal end of the tube 140 sealing the interior of the tube 140. The closure tube 140 and dome 150 features can be further improved by adding a tamper evident truss 200. The truss 200 has an outboard hinged attachment 210 to the tube. The truss also has a break-away attachment 220 centered to the dome and truss between the outer dome and the truss. A space is provided between the truss configuration and tube of the closure and the convex dome for ease of customer use. The truss 200 and break away attachment 220 are also used to prevent the dome from premature inversion in the event a vacuum is formed on the end of the closure inside a vessel.

The closure is activated by moving by pressing on the truss 200 in a manner to fold it away from the dome 150 top. The folding motion shears the break away attachment 220 and is hingedly pivoted beyond the outer edge of the dome toward the radial edge of the tube. The truss 200 is configured to have interfering engagement with the radial edge of the tube to prevent the truss from moving back over the dome. The ingredients inside the tube are released by pressing downwardly onto the dome 150. This action directly acts on the depending septum 180 which is attached to the end cap 190. The end cap 190 is in interfering engagement with the tube 140 sufficient to provide sealing integrity alone as well as the depending septum 180. The dome 150 is pressed downwardly until it inverts and will remain in a now concaved configuration. The septum 180 has moved vertically downward pressing the end cap 190 from its assembled position below the distal end of the tube 140. This motion also breaches the seal of the foil lining 130 allowing the ingredients inside the tube 140 a path way out of the tube 140.

The dome 150 structure can be designed to have a plurality of radial hinge members 160, 170 that are spaced apart throughout the arc of the dome 150. The dome 150 can be configured to contain depending radial ribbing. The end cap 190 can be configured to include a liner in between the end of the septum 180 and the bottom portion of the end cap 190 to provide sealing interface and added removal resistance. The dome 150 can be configured to have a surrounding structure 240 to prevent inadvertent actuation. The end cap 190 and tube 140 can be configured with interfering sealing engagement with a highly polished mating surfaces. These highly polished faces when in intimate contact provide a superior seal integrity against moisture. The materials of the closure 100 and end cap 190 are primarily comprised of propylene and ethylene materials for the preferred embodiment. Alternate materials of flexible nature can also be employed like thermoplastic elastomers and others of a lower modulus sufficient to provide flexibility. The upstanding ring 240 around the dome may be configured with one or more ports or openings to allow easier user access or to drain water after washing.

The invention provides a dispensing closure 100 used to house a secondary supply or dose of product. When the closure is activated the secondary product or dose is dispensed into the main vessel to which it is attached. The inverted dome is a one piece delivery method to supply a dose or supply of product into a vessel to which it is attached. The inverted dome is configured with a septum 180 and a thinner convex dome 150, and an end plate seal 260. The end plate seal 260 can be made from a variety materials that are thin and frangible in nature to fracture when the thinned dome 150 is inverted to a concave shape. The septum 180 applies force against the end plate 260 shearing and fracturing the end plate when the dome is inverted.

The concept can be improved by adding a tear away protective portion 270 which extends above the apex of the dome to prevent accidental inversion of the dome. The tear away band 270 can be configured to extend from the cylinder 140 to which the dome 150 is attached or from the deck 280 of the threaded portion 290 of the cap. The concept can also be provided with a removal protective overcap 300 to protect against accidental inversion of the dome 150.

The concept can be improved by adding a septum end attachment 310. This separate attachment is used to capture a foil seal 130 type of end plate 260. The septum end attachment 310 is configured in a manner to apply uneven pressure on the end plate 260 to reduce the force required to fracture or open the end plate 260. The septum end attachment 310 is generally reduced in diameter from the dose chamber 320 to allow free movement of the septum 180 and dome 150 inversion. The septum end 310 is configured to include a radial bead 330 and is largely cupped in configuration. Once the dome 150 is inverted and septum end attachment 310 acts against the end plate 260 in sufficient force to break away the seal plate 260. The seal plate 260 being flexible enough to accept the cup shaped septum end attachment 310 and hold the flexible seal 260 within the radial beads 330 positioned to the inside of the cupped end of the septum end attachment 310.

Dome 150 features, radial ribs, axial ribs, hinge elements (160, 170), Adding a foil seal 130 to the inside bottom of the end cap 190.

Improving the dome feature sufficient to "pop" over center and stay in a convex shape after pressing.

Adding the radial surrounding structure 240 to prevent inadvertent actuation.

Mating two highly polished mating surfaces between the end cap 190 and the tube 140 to maintain product integrity.

Designing alignment features to keep the end cap 190 and tube 140 in axial alignment.

Septum 180 features to maintain axial alignment during the ejection process of molding and accepting the end cap 190.

Fewer parts, less plastic, easier to use, no twisting motion no long sleeves for product to interfere with in operation. Improved product efficacy, easier assembly, easier filling, Top view in assembly with protective overcap 300, FIG. 3 is a cross sectional view in assembly with protective overcap 300.

Figures 1, 2, 3, 4, 5, 6:
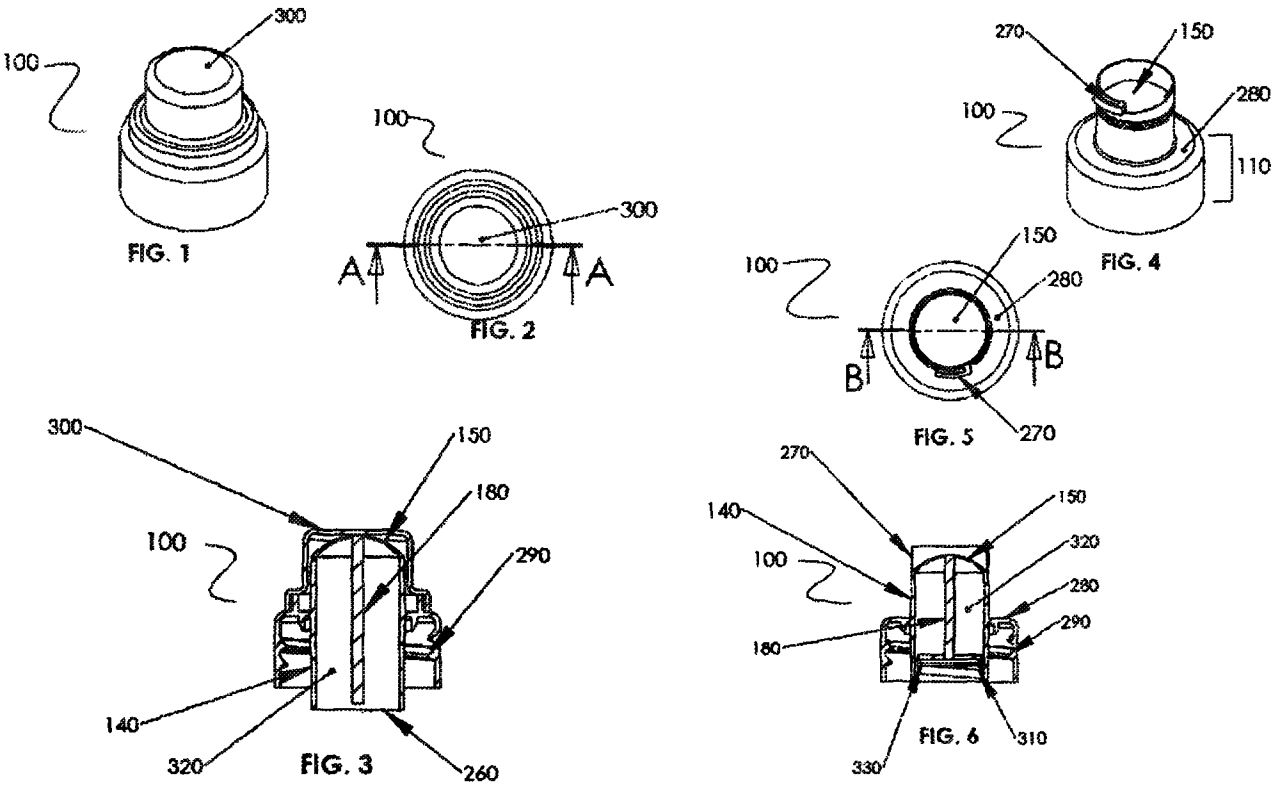
FIG. 1: Perspective view of the inverted dome concept with protective overcap.
FIG. 2: Top view of the inverted dome concept with the protective overcap.
FIG. 3: Cross section view of the inverted dome concept in assembly.
FIG. 4: Perspective view of the inverted dome concept with a tear away pull tab to remove protective device.
FIG. 5: Top view of the inverted dome concept with a tear away pull tab device.
FIG. 6: Cross section view of the inverted dome concept with a tear away pull tab device.

Top view with protective tear away 270 means, FIG. 6 with septum end attachment 310 in assembly.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A dispensing closure to supply a dose comprising: a housing; wherein the housing comprises a tube, a septum, a dose chamber, a convex dome, an end plate seal, and a septum end attachment, wherein the dome and septum are attached;

wherein the dome is inverted by pressing downwardly onto the dome and requiring no twisting motion, wherein the dome is configured with a plurality of radial hinge members which allow the dome to flex to a maximum inverted position, wherein the dome when inverted to a concave configuration causes the septum to apply a pressing force against the end plate seal, wherein the septum end attachment is attached to the distal end of the septum and applies uneven pressure on the end plate seal to reduce the force required to fracture or open the end plate seal, resulting in fracturing or opening of the end plate seal and release of the dose from the dose chamber, wherein the inverted dome remains in a concave configuration.

2. The dispensing closure of claim 1, wherein a main vessel is attached to the closure.

3. The dispensing closure of claim 2, wherein the main vessel is a bottle.

4. The dispensing closure of claim 3, wherein the dose chamber is capable of storing one or more ingredients.

5. The dispensing closure of claim 1, wherein the septum depends from the apex of the convex dome toward a base of the housing.

6. The dispensing closure of claim 1, wherein the end plate seal comprises a foil liner.

7. The dispensing closure of claim 1, further comprising a closure radial skirt attached to the outer diameter of the housing.

8. The dispensing closure of claim 7, wherein the closure radial skirt further comprises a frangible skirt, removably attached to the edge of the closure radial skirt.

9. The dispensing closure of claim 1, further comprising a fold away truss that prevents inadvertent inversion of the dome, wherein the fold away truss folds out of the way pivoting on two hinged members connected to an outer diameter of the housing.

10. The dispensing closure of claim 9, wherein the fold away truss has a break-away attachment connecting the underside of the truss to the distal edge of the convex dome, wherein the break-away attachment connects at the apex of the convex dome.

11. The dispensing closure of claim 1, further comprising a removable protective overcap covering the convex dome.

12. The dispensing closure of claim 1, further comprising a standing radial rim attached to a proximal radial edge of the housing and extending beyond a proximal end of the convex dome, wherein the standing radial rim comprises a pull tab to remove the standing radial rim before inversion of the dome.

13. A dispensing closure to supply a dose comprising a housing, wherein the housing comprises a tube, septum, a dose chamber, a convex dome, and an end cap, wherein the dome, septum and end cap are attached, wherein a distal end of the septum receives the end cap in mating engagement, wherein the end cap and the tube are in interfering sealing engagement with polished mating surfaces providing seal integrity against moisture, wherein the dome is inverted by pressing downwardly onto the dome and requiring no twisting motion, wherein the dome is configured with a plurality of radial hinge members which allow the dome to flex to a maximum inverted position, wherein one hinge is at the radial edge of the tube and another hinge is at the radial edge of the septum, wherein the dome when inverted to a concave configuration results in the septum moving vertically downward pressing the end cap from its assembled position below a distal end of the tube, releasing the dose from the dose chamber, wherein the inverted dome remains in a concave configuration.

14. The dispensing closure of claim 13, wherein the end cap is configured to include a liner in between the end of the septum and bottom portion of the end cap to provide sealing interface and added removal resistance.

15. The dispensing closure of claim 14, wherein the liner is a foil liner.

16. The dispensing closure of claim 13, wherein a main vessel is attached to the closure.

17. The dispensing closure of claim 16, wherein the main vessel is a bottle.

18. The dispensing closure of claim 13, further comprising a closure radial skirt attached to the outer diameter of the housing.

19. The dispensing closure of claim 18, wherein the closure radial skirt further comprises a frangible skirt, removably attached to the edge of the closure radial skirt.

20. The dispensing closure of claim 13, further comprising a fold away truss that prevents inadvertent inversion of the dome, wherein the fold away truss folds out of the way pivoting on two hinged members connected to an outer diameter of the housing.

21. The dispensing closure of claim 13, further comprising a removable protective overcap covering the convex dome.

22. The dispensing closure of claim 1, further comprising a standing radial rim attached to a proximal radial edge of the housing and extending beyond a proximal end of the convex dome, wherein the standing radial rim comprises a pull tab to remove the standing radial rim before inversion of the dome.

* * * * *